US007197999B2

(12) United States Patent
Murray

(10) Patent No.: US 7,197,999 B2
(45) Date of Patent: Apr. 3, 2007

(54) SPAR DISCONNECT SYSTEM

(75) Inventor: John Murray, Houston, TX (US)

(73) Assignee: Technip France, Courbevoie (FR)

( * ) Notice: Subject to any disclaimer, the term of this patent is extended or adjusted under 35 U.S.C. 154(b) by 0 days.

(21) Appl. No.: 11/247,950

(22) Filed: Oct. 11, 2005

(65) Prior Publication Data

US 2006/0075953 A1 Apr. 13, 2006

Related U.S. Application Data

(60) Provisional application No. 60/617,346, filed on Oct. 8, 2004.

(51) Int. Cl.
*B63B 35/44* (2006.01)

(52) U.S. Cl. ..... 114/264; 405/205

(58) Field of Classification Search ..... 114/263, 114/264, 265, 266, 267; 405/195.1, 200, 405/205, 207, 209, 224
See application file for complete search history.

(56) References Cited

U.S. PATENT DOCUMENTS 6,012,873 A * 1/2000 Copple et al. ..... 405/224
6,092,483 A 7/2000 Allen et al.
6,227,137 B1 * 5/2001 Allen et al. ..... 114/264
6,263,824 B1 * 7/2001 Balint et al. ..... 114/264
6,666,624 B2 * 12/2003 Wetch ..... 405/205
6,786,679 B2 * 9/2004 Huang et al. ..... 405/209
6,968,797 B2 * 11/2005 Persson ..... 114/264
2002/0154954 A1 10/2002 Huang et al.
2003/0031517 A1 2/2003 Welch

* cited by examiner

*Primary Examiner*—Lars A. Olson
(74) *Attorney, Agent, or Firm*—Klein, O'Neill & Singh, LLP; Howard J. Klein

(57) ABSTRACT

A spar-type offshore platform includes a buoyant upper hull structure supporting a deck and having lower end in which is received a buoyant lower mooring module. The upper hull structure is connected to the mooring module by connection lines. The upper hull structure is removed from the mooring module by disconnecting the connection lines from the upper hull structure while leaving the connection lines attached to the mooring module and while the mooring module remains moored to the seabed. The mooring module is lowered relative to the upper hull structure, allowing the latter to be moved away. The upper hull structure may be re-positioned over the mooring module, and the mooring module may be hauled upward into engagement with the lower end of the upper hull structure, so that the connection lines can be recovered and re-attached to the upper hull structure.

37 Claims, 8 Drawing Sheets

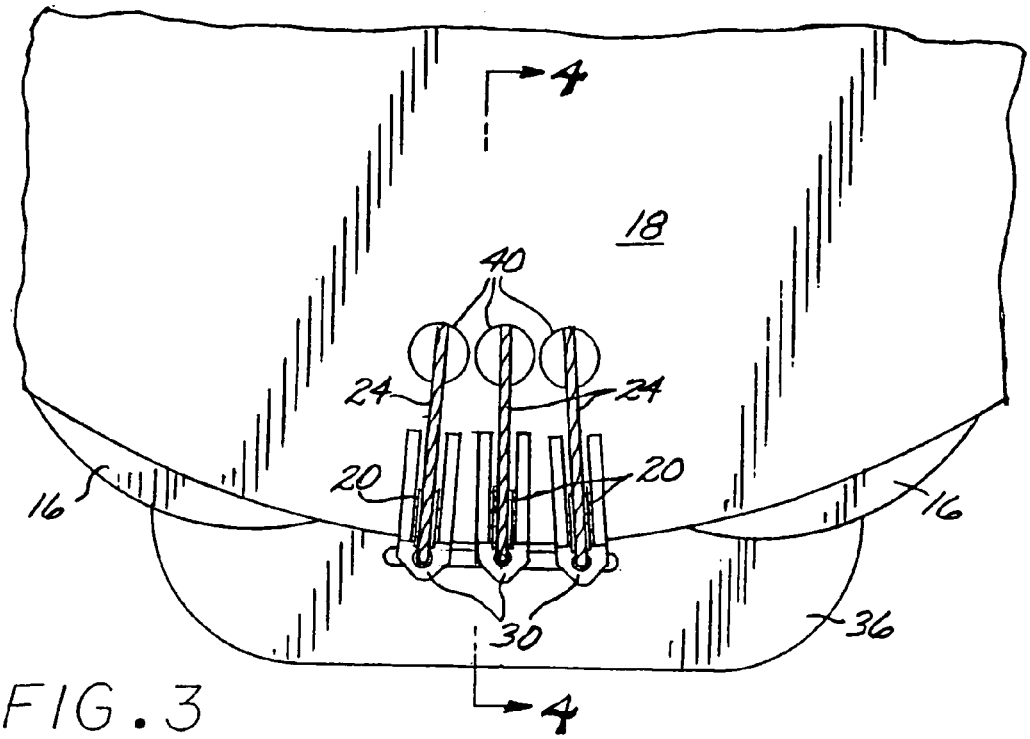
FIG. 3
FIG. 4
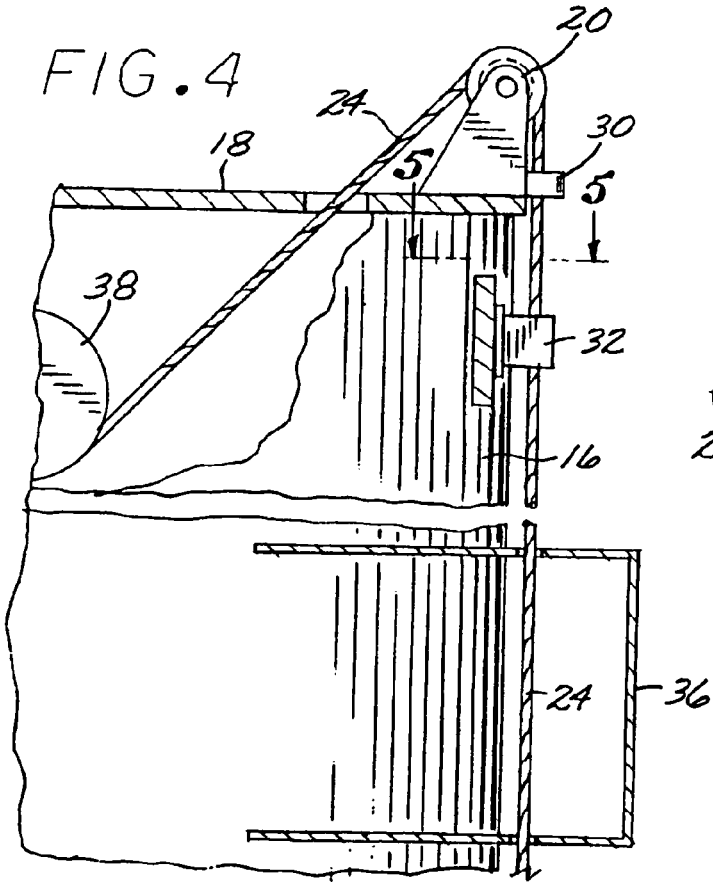
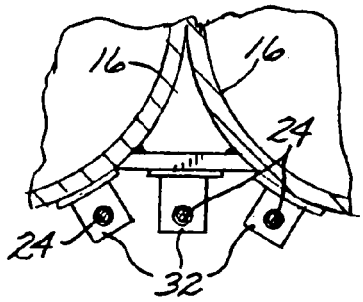
FIG. 5

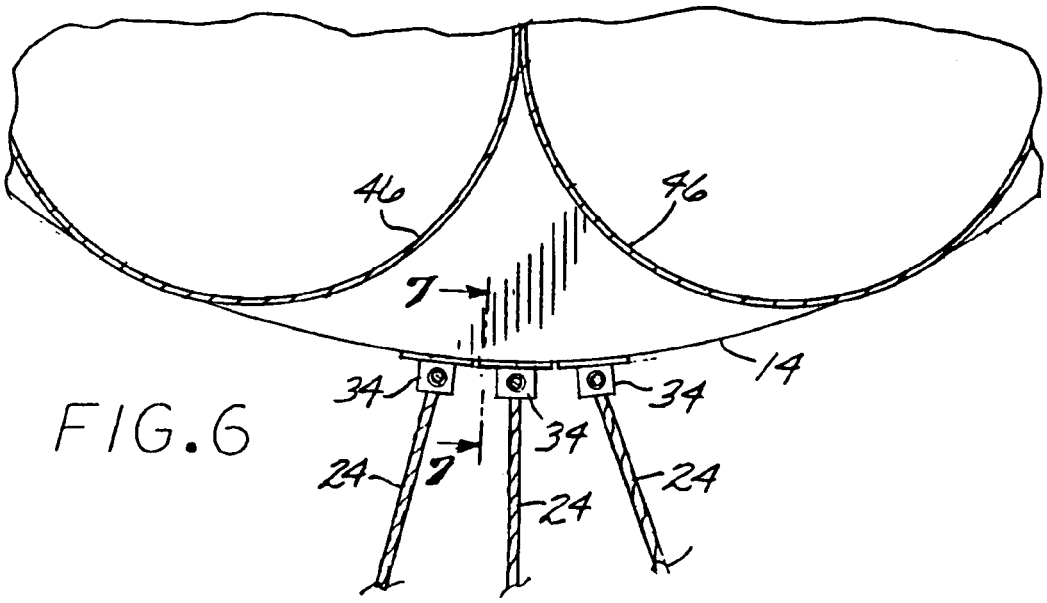
FIG.6
FIG.7
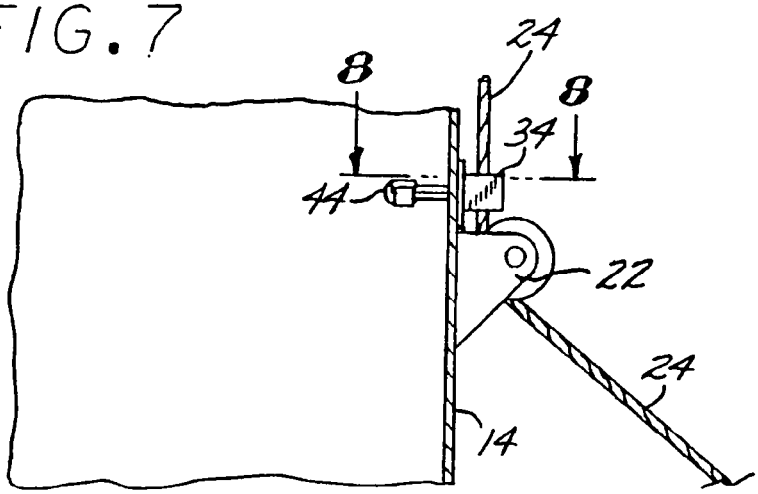
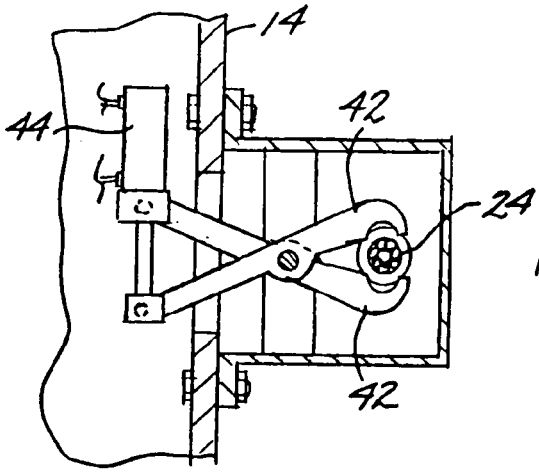
FIG.8

SPAR DISCONNECT SYSTEM

CROSS-REFERENCE TO RELATED APPLICATION

This application claims the benefit, under 35 U.S.C. §119(e), of co-pending provisional application No. 60/617,346, filed Oct. 8, 2004, the disclosure of which is incorporated herein by reference.

FEDERALLY SPONSORED RESEARCH OR DEVELOPMENT

Not Applicable

BACKGROUND OF THE INVENTION

This application relates to offshore platforms for the exploration for, and production of, undersea petroleum deposits, and, in particular, to the various types of platforms generically known as spars, whether of the classic, truss, or cell spar variety. More specifically, the present invention relates to a spar-type platform, of the type having a buoyant upper hull structure and a lower buoyant section or module that supports the mooring and risers when the upper hull structure is detached, in which the lower section is constructed as a sub-sea mooring buoy (SSMB), wherein the upper hull section is detachably connected to the lower (SSMB) section.

The development of sub-sea petroleum and natural gas deposits in Arctic deep water regions presents special challenges for offshore platform designs. Specifically, platforms in these regions must be able to resist local and global loads from ice in addition to loads conveyed by wind, waves, and currents. In some cases, a platform must be moved to avoid contact with or collision with sea ice and icebergs.

One type of platform that has become widely used for the development of deep water deposits is the spar, especially spars that provide for the storage of petroleum or natural gas. The threat of ice would make it advantageous for the hull of the spar, containing storage or not, to be disconnectable or detachable from its mooring and riser system to avoid impact from the ice. Also, the staged development of a particular deposit may be facilitated by changing out topside facilities (by the detachment of the upper hull structure) as development progresses.

SUMMARY OF THE INVENTION

Broadly, the present invention is a spar-type platform comprising an upper hull structure that supports the topside facilities and equipment and that provides the buoyancy and ballasting functions and (optionally) a storage function (as in a typical spar), and a lower hull structure or module that forms part of the mooring system and that functions as a sub-sea mooring buoy (SSMB). The upper hull structure and the SSMB module are connected by a detachable connection mechanism, whereby the upper hull structure can be detached from the SSMB module and moved, either by towing or by an on-board propulsion system, to avoid or evade an environmental threat (e.g., floating ice or an iceberg), and then reattached to the SSMB module when the threat has passed. The SSMB module is sized for buoyantly supporting the mooring lines and the riser system that are left behind when the upper hull section is detached and removed.

In the attached condition, the two hull structures are connected by a plurality of connection lines (which can be chains, steel ropes, cables, or combinations thereof) that run from a plurality of chain jacks or fairleaders on the deck of the upper hull section, and through a fairleader/pulley mechanism mounted on the SSMB module. These connection lines can be part of the mooring system, or additional lines can be used to make the connection, or a combination of both can be used. (If additional lines are used in conjunction with the mooring lines, they are referred to as "tie lines.") During the disconnection process, these lines are slackened at the deck level and removed from the fairleader/pulleys on the SSMB module. These lines are then carried away by the upper hull structure.

In a specific embodiment in which mooring lines are used to connect the two hull structures, the mooring lines are run through chain jacks and chain stoppers mounted on the upper hull structure in the traditional configuration, and they are run down the outside of the spar. Another set of chain stoppers is provided on the SSMB module to maintain tension in the mooring lines between the upper hull structure and the SSMB module. These lines are run through fairleaders mounted on the SSMB module. During the disconnection process, the mooring lines are lowered using guide lines and locked off at the fairleaders. They remain supported by the SSMB module during disconnection. The guide lines are dropped from the upper hull structure and allowed to hang from the SSMB fairleaders.

The weight of the mooring lines and risers, now unsupported by the buoyancy provided by the upper hull structure, causes the SSMB module to separate from the upper hull structure. The SSMB module, carrying the mooring lines and risers, moves downward, controlled by a chain in the centerwell, until the effective weight of the risers and mooring lines is decreased as they lay on the sea floor, until the weight of the mooring lines and risers is equal to the buoyancy of the SSMB module.

The upper side of the SSMB module carries a plurality of upwardly-extending guide posts and a guiding structure that is rigidly fixed to the top of the SSMB module. The guide posts and guiding structure provide the proper alignment between the upper hull structure and the SSMB. The guiding structure also includes a pneumatically- or hydraulically-controlled interface template for the connection of the risers between the upper hull structure and the SSMB module, and it provides structural strength to the connection by fitting inside the underside of the upper hull structure.

For reconnecting the two hull sections, the upper structure is maneuvered above the SSMB module. A haul-in line (chain or steel rope) is lowered and connected to the apex of the guiding structure using a remotely-operated vehicle (ROV). To assist in aligning the upper hull structure and the SSMB, guide post lines are lowered through guide post receptacles on the upper hull structure from the deck of the upper hull structure. The guide post lines are attached to the tops of the guide posts by an ROV. In combination with the haul-in line attached to the apex of the guiding structure, the guide post lines pull the guide posts into their respective receptacles, thereby aligning the upper hull structure and the SSMB. A winch on the upper hull structure draws the SSMB module into a docking bay in the bottom of the wellbay of the upper hull structure, with the guide posts engaging the receptacles to guide the SSMB module into place. The mooring lines are retrieved using an ROV, and they are winched back to the chain jacks. The tie-lines, if used, are reconnected around the fairleaders and tensioned to the deck of the upper hull structure.

BRIEF DESCRIPTION OF THE DRAWINGS

FIG. 3 is a detailed view of the portion enclosed within the dashed outline 3 in FIG. 2;

FIG. 4 is a cross-sectional view taken along line 4—4 of FIG. 3;

FIG. 5 is a cross-sectional view taken along line 5—5 of FIG. 4;

FIG. 6 is a cross-sectional view taken along line 6—6 of FIG. 1;

FIG. 7 is a cross-sectional view taken along line 7—7 of FIG. 6;

FIG. 8 is a cross-sectional view taken along line 8—8 of FIG. 7;

DETAILED DESCRIPTION OF THE INVENTION

Figures 1, 2:
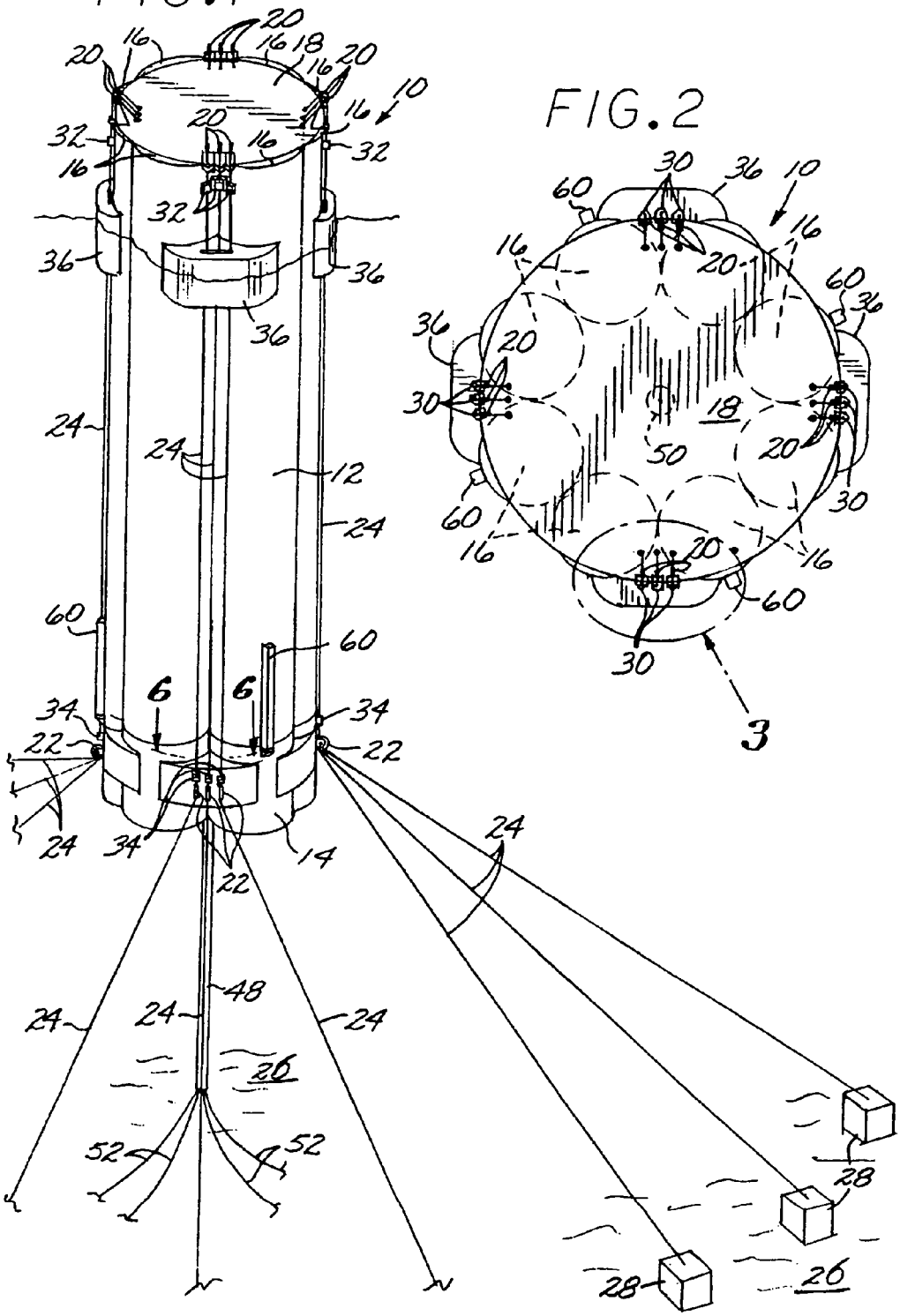
FIG. 1 is a perspective view of a spar-type platform in accordance with a first embodiment of the present invention.
FIG. 2 is a top plan view of the spar-type platform of FIG. 1.
Figure 9:
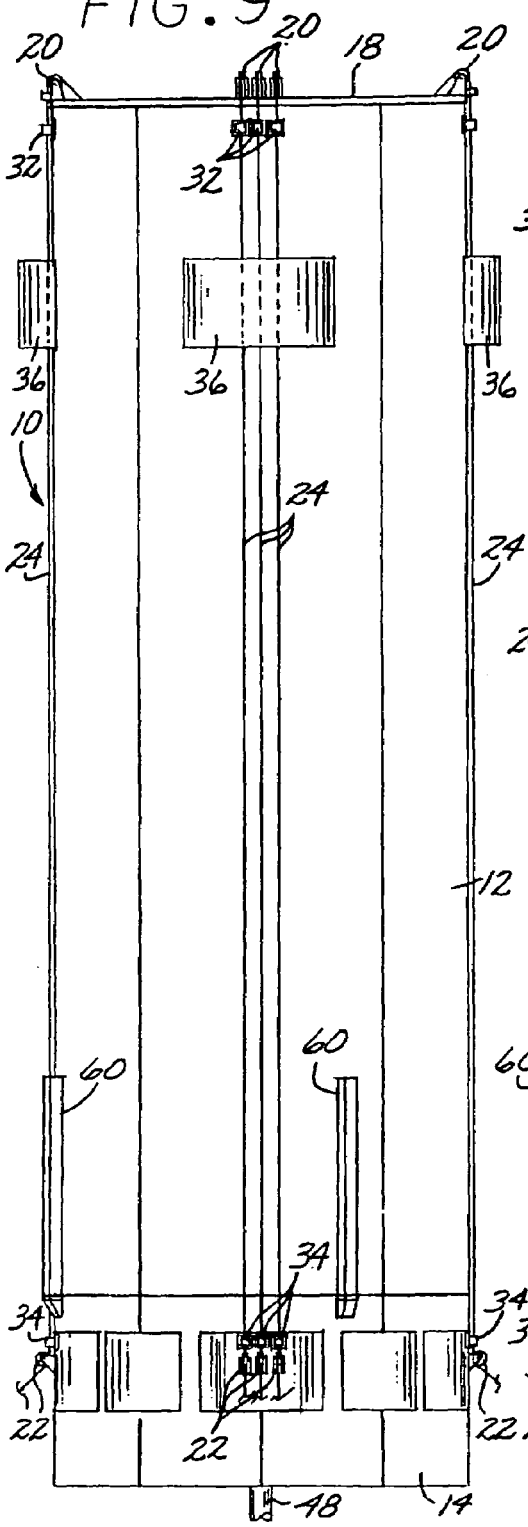
FIG. 9 is a side elevational view of the spar-type platform of FIG. 1.

Referring now to the drawings, and particularly FIGS. 1, 2, and 9, a spar-type platform 10, in accordance with a preferred embodiment of the invention, includes an upper hull structure 12 and a buoyant lower section or module, configured as a sub-sea mooring buoy (SSMB) 14, wherein the upper hull structure 12 and the SSMB module 14 are detachably connected to each other so that the upper hull structure 12 can be removed from the SSMB module 14 and relocated, either by towing or under its own power. The SSMB module 14 can be subsequently retrieved and reconnected to the upper hull structure 12. The invention is described herein in the context of a cell spar, but it will be understood that it is easily adaptable for use with a so-called "classic" spar and with a truss spar.

The upper hull structure 10 comprises a plurality of interconnected elongate, hollow cells 16, each of which may be divided by a series of vertically-spaced, transverse bulkheads (not shown) into a plurality of compartments (not shown), as is well-known in the art. The uppermost compartments are typically air-filled to provide buoyancy, while the lowermost compartments are typically filled with seawater to provide ballast, so as to keep the platform upright. The intermediate compartments may be used for the storage of petroleum. The tops of the cells 16 support a deck 18, on which are installed the topside facilities and equipment (not shown) that are typical for such platforms.

Spaced around the periphery of the deck 18 are a plurality of upper line holding elements 20, which may be chain jacks or fairleaders. Similarly spaced around the periphery of the SSMB module 14 are a plurality of lower line holding elements 22, which may likewise be chain jacks or fairleaders. A plurality of mooring lines 24 are anchored in the seabed 26 by anchors 28. Each of the mooring lines 24 is run through one of the lower chain jacks or fairleaders 22, then up the side of the upper hull structure 12 and through a guide element 30, and then through one of the upper fairleaders 20. The mooring lines 24 are secured to the upper hull structure 12 by means of upper chain stoppers or cable locks 32, and to the SSMB module 14 by means of lower chain stoppers or cable locks 34. Thus, the extended mooring lines 24 serve as connection lines for connecting the upper hull structure 12 to the SSMB module 14.

Alternatively, the mooring lines 24 may extend only between the SSMB module 14 and the anchors 28, with the connection between the upper fairleaders 20 and the lower fairleaders 22 being provided by tie lines, as discussed below with reference to FIG. 10. The mooring lines 24 (or tie lines, as the case may be) are run through protective shrouds 36 that are advantageously provided on the exterior of the upper hull structure 12 at the water line.

As best shown in FIGS. 3–5, a preferred arrangement for the mooring/tie lines 24 is to have them wound on winches 38 (only one of which is shown in FIG. 4) mounted below the deck 18 of the upper hull structure 12. Each line 24 then extends through a deck aperture 40 before being run through the pulley of an upper fairleader 20, then down through a guide element 30 and an upper cable lock or chain stopper 32 before passing through a shroud 36 as it descends along the side of the upper hull structure 12. As shown in FIGS. 6 and 7, at the SSMB module 14, each of the lines 24 passes through a lower cable lock or chain stopper 34 before passing through the pulley of a lower fairleader or chain jack 22.

FIG. 8 illustrates one type of locking mechanism that may be used for the upper cable lock/chain stoppers 20 and/or the lower cable lock/chain stoppers 22. In this mechanism (which is described by way of example only), a pair of opposing pivoting clamp arms 42, actuated by a hydraulic or pneumatic cylinder 44, clamp down on the line 24 when the locking mechanism is actuated, and they release the line when the mechanism is de-actuated.

Figure 10:
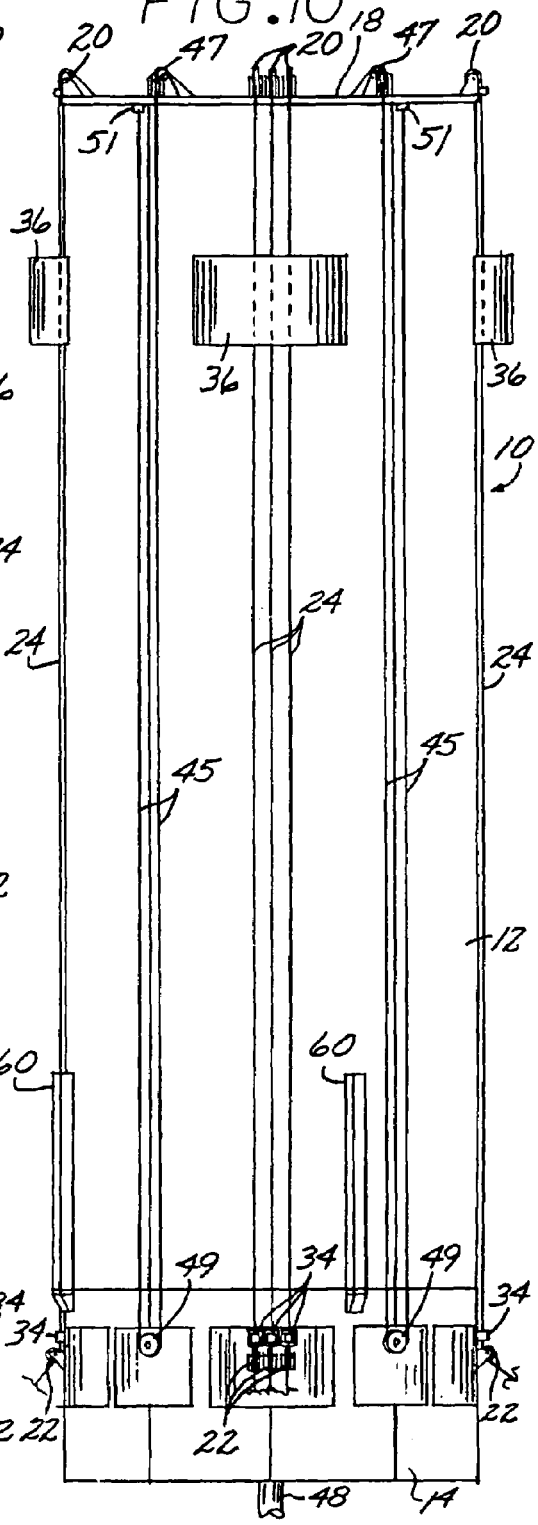
FIG. 10 is a side elevational view of a modified form of the spar-type platform of FIG. 1.

FIG. 10 illustrates a modification of the present invention, in which a plurality of tie lines 45 are used as connection lines to connect the upper hull structure 12 to the SSMB module 14, instead of or in addition to the extended mooring lines 24 described above. Each of the tie lines 45 is fed from a tie line winch 47 on the deck 18, and then it extends down along the side of the platform 10, loops around a line guide 49, such as a pulley, on the SSMB 14, and then extends back up to an anchor point 51 on the deck 18. With this modification, the upper hull structure 12 is disconnected from the SSMB module 14 by feeding slack to the tie lines 45 until they decouple from their respective line guides 49, freeing the SSMB module 14 from the upper hull structure 12. The tie lines 45 are carried away with the upper hull structure 12. In re-connecting the upper hull structure 12 to the SSMB module 14, an ROV (not shown) is used to couple the tie lines 45 to their respective line guides while the winches 47 take in the slack to tighten the tie lines 45 up on the line guides 49.

The SSMB module 14 comprises a plurality of buoyancy cells or chambers 46 (FIG. 6) arranged around a central passage through which a lower riser casing 48 (see FIG. 1) passes. The upper end of the lower riser casing 48 is detachably connected to the lower end of an upper riser casing 50 (see FIG. 2) that extends axially through the upper hull structure 12. A plurality of risers 52 (see FIG. 1), having lower ends that are connected by flexible jumpers (not shown) to seabed wellheads (not shown), pass through the riser casings 48, 50 for connection to appropriate structures on the deck 18, as is well-known and conventional in the art. The risers 52 are separable into bottom and top portions that are detachably connected to each other at a riser interface template (not shown) that is included in a guiding structure 54 fixed to the top of the SSMB module 14, as further described below. The specific configuration of the interface template will depend upon the specific configuration of the risers and control lines in a given platform, but the use of such templates in offshore platform applications is known, and the design of suitable templates for the purpose of this invention is considered to be within the ability of those of ordinary skill in the pertinent arts.

As shown in FIGS. 12–15, the guiding structure 54 is affixed to the top of the SSMB module 14. The guiding structure 54 is a truss structure that nests into a sub-surface docking bay 55 in the bottom of the upper hull structure 12. The guiding structure 54 has an upper apex to which is fixed a connection element 56 (which may be a hook, a loop, or equivalent structure) that is removably connected to a haul-in line (cable or chain) 66 by means of a hook 68 or the equivalent thereof. The haul-in line 66 is raised and lowered by a haul-in winch 70 on the deck 18 of the upper hull structure 12 (see FIG. 14), and it is employed in the process of separating the upper hull structure 12 from the SSMB module 14, and in the process of re-attaching the SSMB module 14 to the upper hull structure 12, as described below. The top of the SSMB module 14 also includes the above-mentioned interface template (not shown) for the attachment of the lower riser casing 48 to the upper riser casing 50, and for the attachment of the top and bottom portions of the risers 52, as mentioned above. The interface template may also include means for detachably connecting control lines (not shown) that typically extend from the deck 18 to the wellheads.

Figure 16:
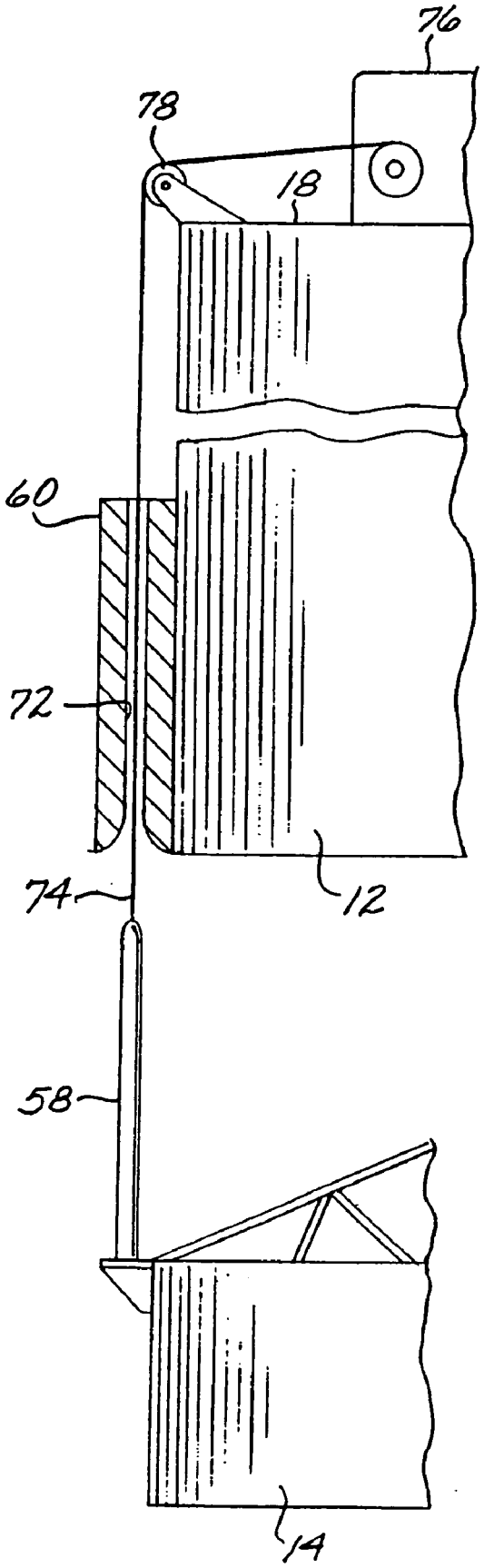
FIG. 16 is a detailed cross-sectional view showing a guide post, guide post receptacle, and guide post line used to align the SSMB module and the upper hull structure.

A plurality of guide posts 58 are spaced around the periphery of the SSMB module 14 and extend upwardly therefrom. A plurality of guide post receptacles 60 are located around the periphery of the upper hull structure 12, near the lower end thereof, so as to receive the guide posts 58 when the SSMB module 14 is connected to the upper hull structure 12. As shown in FIG. 16, each of the guide post receptacles 60 is formed as a tubular element with an axial passage 72 therethrough. A plurality of guide post lines 74 (one of which is shown in detail in FIG. 16) are raised and lowered through the guide post receptacle passages 72 by guide post line winches 76 and guide post line pulleys 78 mounted on the deck 18 of the upper hull structure 12, and the end of each of the guide post lines 74 is detachably fastened to the top of a respective guide post 58.

Figure 11:
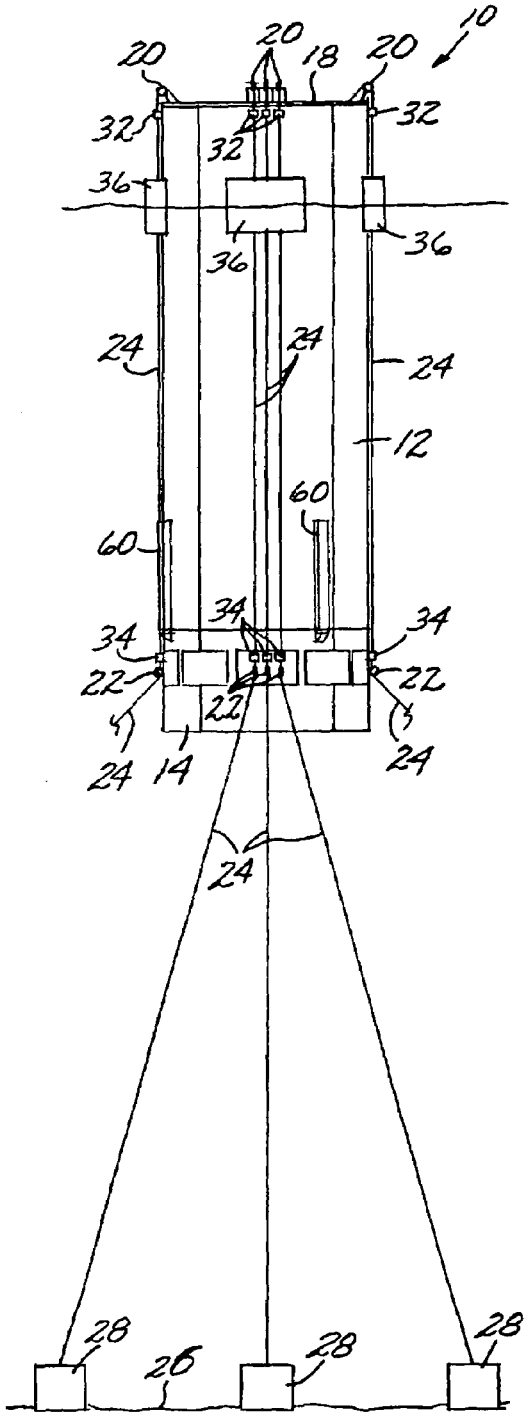
FIG. 11 is a side elevational view of the spar-type platform of FIG. 1, showing the upper hull structure connected to the SSMB module, the latter being moored to the seabed.
Figure 12:
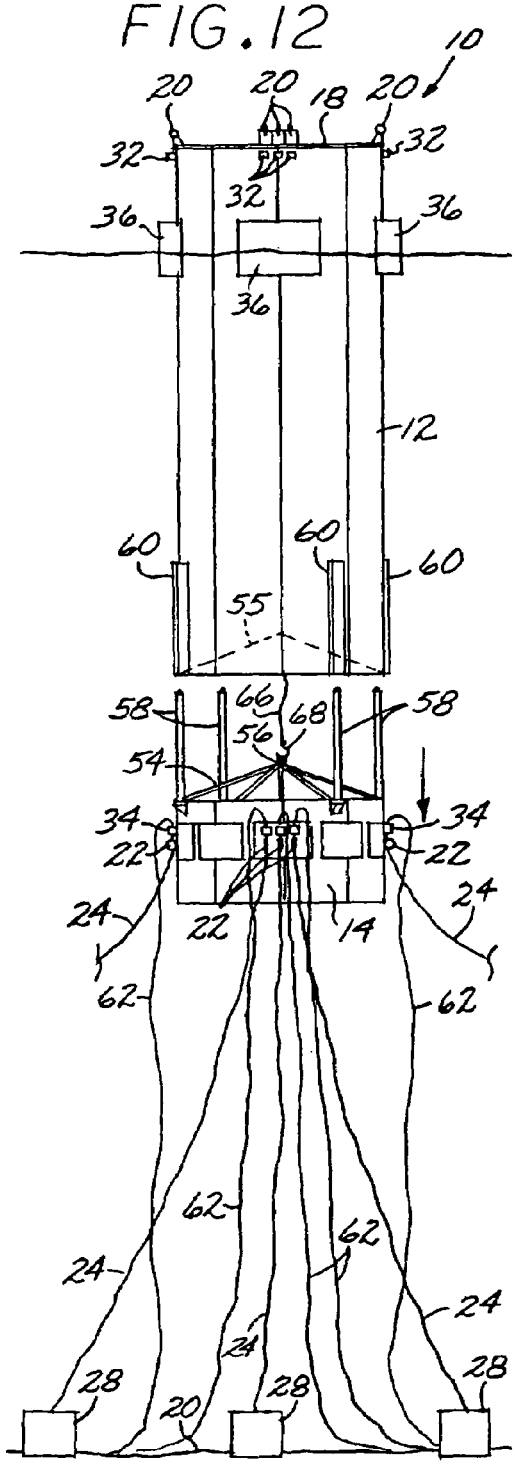
FIG. 12 is a side elevational view of the spar-type platform of FIG. 1, showing the disconnection of the upper hull structure from the SSMB module.
Figure 13:
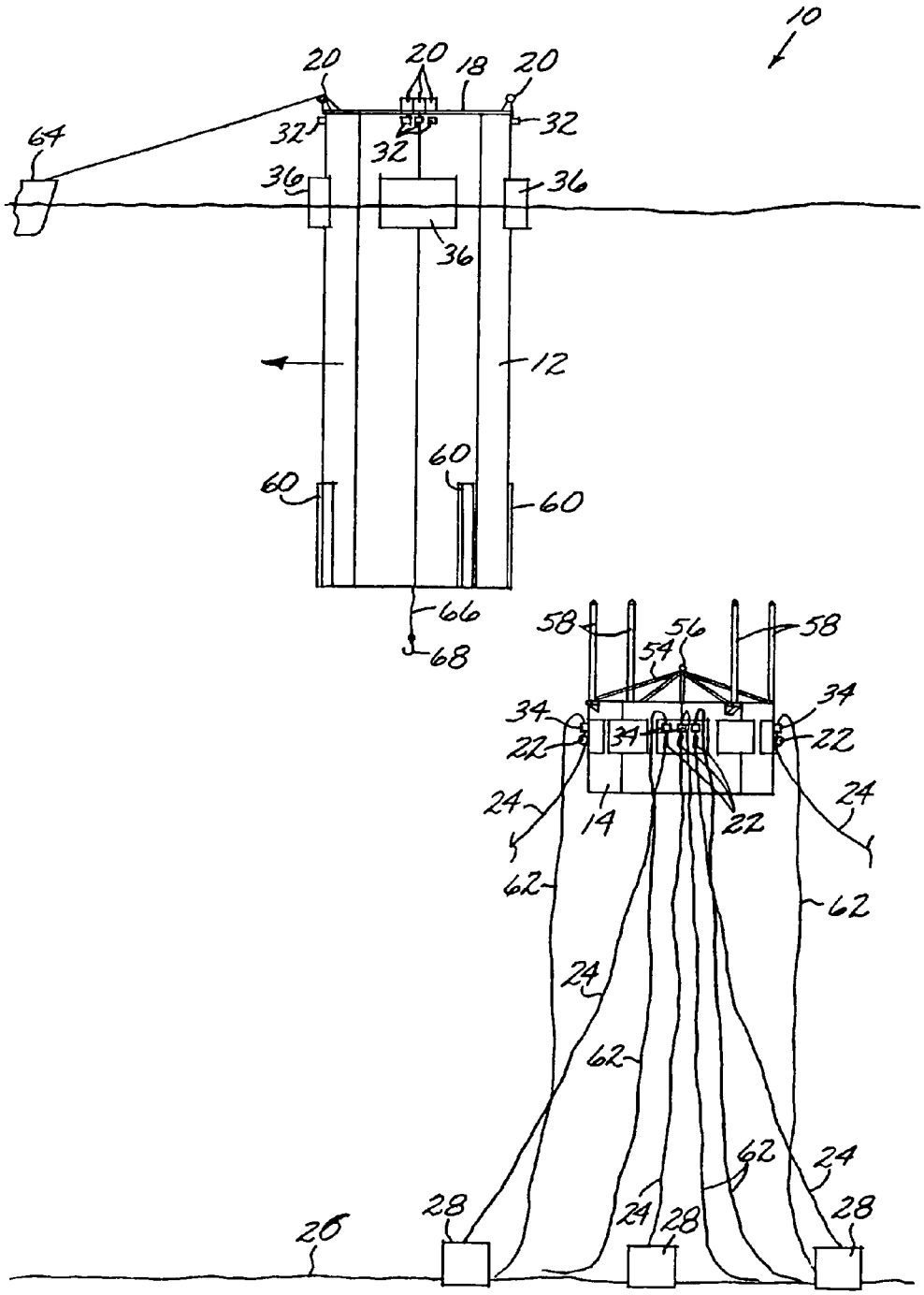
FIG. 13 is a side elevational view of the spar-type platform of FIG. 1, showing the upper hull structure being towed away from the SSMB module after disconnection.

The process of disconnecting and removing the upper hull structure 12 from the SSMB module 14 is illustrated in FIGS. 11–13. FIG. 11 shows the spar platform 10 with the upper hull structure 12 connected to the SSMB module 14. At the beginning of the disconnection process, as illustrated in FIG. 12, the mooring lines 24 are lowered using guide lines 62 and locked off at the lower chain jacks or fairleaders 22. The mooring lines 24 remain supported by the SSMB module 14 during disconnection. The guide lines 62 are dropped from the upper hull structure and allowed to hang from the SSMB chain jacks or fairleaders 22.

The weight of the mooring lines 24 and the bottom portions of the risers 52, now unsupported by the buoyancy provided by the upper hull structure 12, causes the SSMB module 14 to sink, controlled by the haul-in line 66 and the guide post lines 74, and thus to separate from the upper hull structure 12. The SSMB module 14 continues to sink as the effective weight of the riser bottom portions and the mooring lines 24 decreases as they settle on the sea floor, until the weight of the mooring lines and risers is equal to the buoyancy of the SSMB module 14.

As shown in FIG. 13, the haul-in line 66 is disconnected from the guiding structure 54 on the SSMB module 14 (the guide post lines 74 having been disconnected from their respective guide posts 58), and the upper hull structure 12 is towed away by a vessel 64. Alternatively, the upper hull structure 12 may have its own propulsion system (not shown), so that it cam move away from the SSMB module 14 under its own power.

Figure 14:
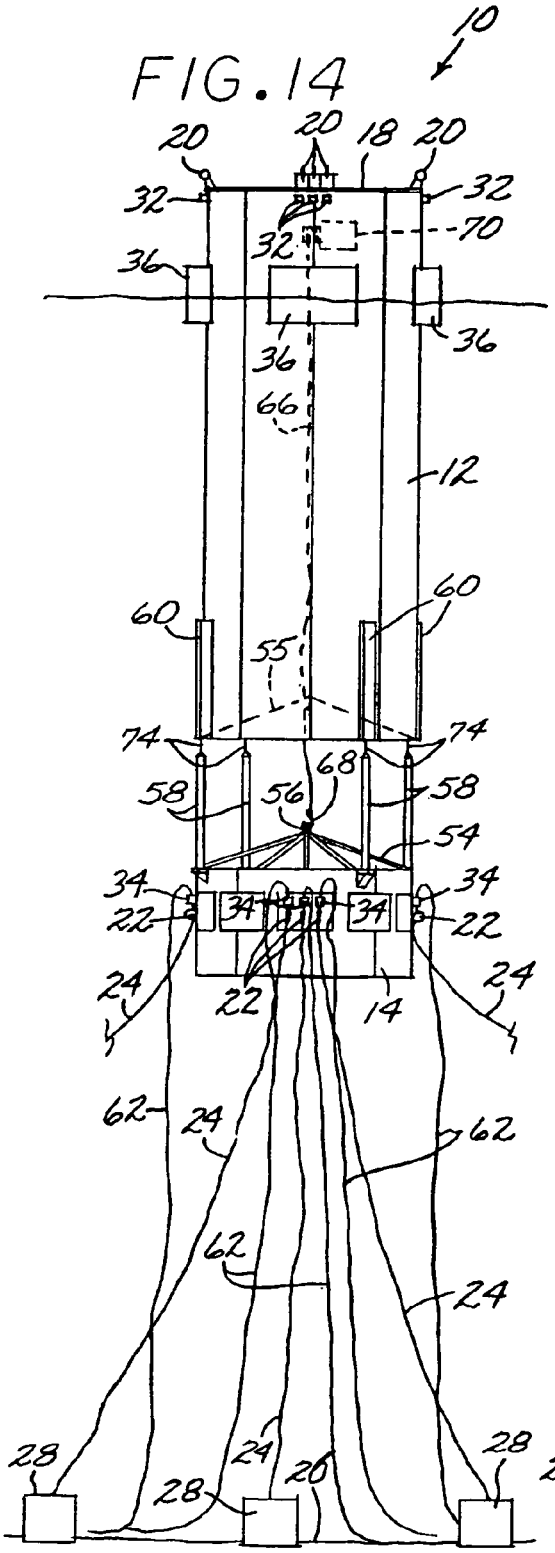
FIG. 14 is a side elevational view of the spar-type platform of FIG. 1, showing the upper hull structure positioned above the SSMB module during retrieval of the SSMB for re-attachment of the SSMB module to the upper hull structure.
Figure 15:
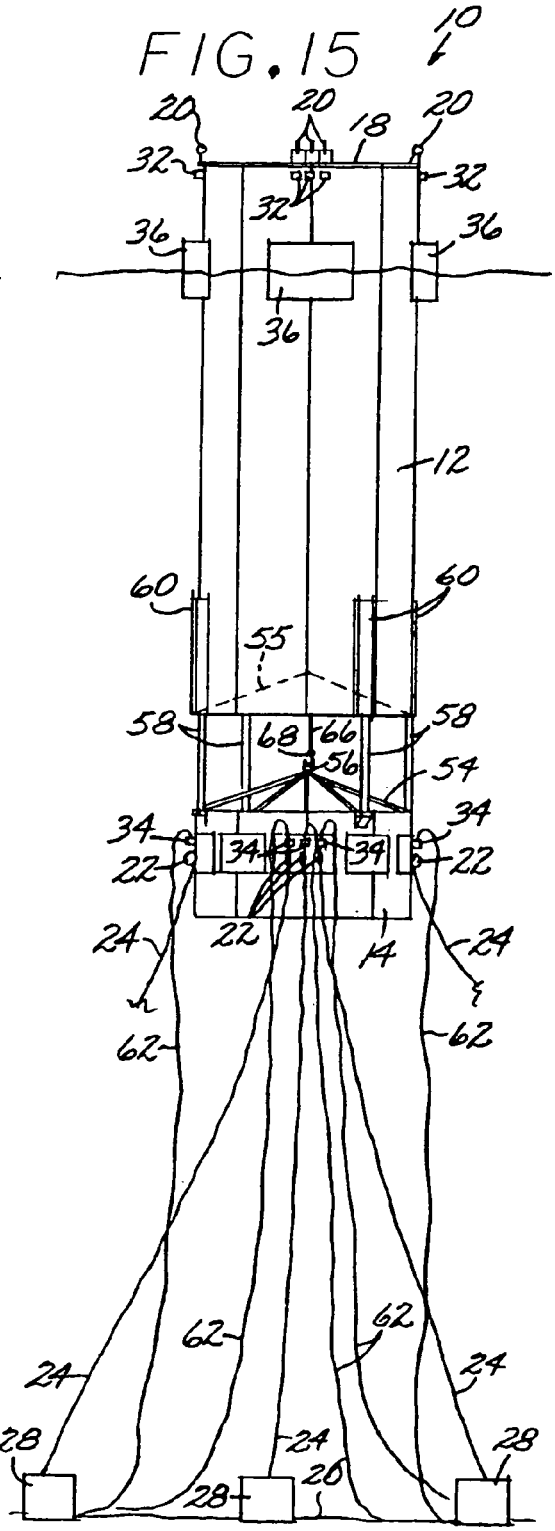
FIG. 15 is a side elevational view of the spar-type platform of FIG. 1, showing the step of drawing the SSMB module toward the upper hull structure for re-attachment of the SSMB module to the upper hull structure.

When it is desired to re-connect the upper hull structure 12 to the SSMB module 14, the upper hull structure 12 is positioned over the SSMB module, as shown in FIG. 14, and the haul-in line 66 with the hook 68 on its end is lowered by the haul-in winch 70. The hook 68 is engaged with the connection element 56 by means such as an ROV (not shown). The ROV also re-attaches the guide post lines 74 to their respective guide posts 58. The SSMB module 14 is hauled upwardly toward the bottom of the upper hull structure 12, as shown in FIG. 15, by the haul-in line 66. As the SSMB module 14 rises, the guide posts 58 on the SSMB module 14 are aligned with their respective receptacles 60 by means of the guide post lines 74, whereby each of the guide posts 58 registers with and enters the appropriate corresponding guide post receptacle 60 on the upper hull structure 12. By this process, the guiding structure 54, with its interface template, is properly seated in the docking bay 55 of the upper hull structure 12 for the re-attachment of the upper and lower portions of the risers 52 and for the re-attachment of any control lines that need to be re-connected. The ROV may then recover the guide lines 62 for re-attaching the mooring lines 24 to the upper hull structure 12 in the manner discussed above.

While a preferred embodiment of the invention has been described herein, it has been set forth by way of example only, and is meant to encompass a wide range of equivalent structures. It will be appreciated that a number of variations and modifications will suggest themselves to those skilled in the pertinent arts, and that many of the components and mechanisms specifically described in this specification will find equivalents in the technical arts that are applicable to the present invention. Thus, for example, as mentioned above, the present invention will be readily adaptable to the various types of spar-type platforms known in the art, and the modifications necessary or advantageous to accommodate the invention to various types of spars will be easily understood by those skilled in the pertinent arts. Also, as will be appreciated by those skilled in the pertinent arts, the term "line" as used in this specification, is meant to encompass a cable, a chain, a steel rope, or any functional equivalent thereof. Likewise, the line holding mechanisms described herein may encompass any suitable mechanism available in the art that may accomplish the functions ascribed to these mechanisms. These and other modifications and variations should be considered within the spirit and scope of the present invention, as defined in the claims that follow.

What is claimed is:

1. A spar-type offshore platform, comprising:

an upper hull structure buoyantly supporting a deck, the upper hull structure having a lower end defining a sub-surface docking bay; and a buoyant sub-sea mooring module detachably connected to the upper hull structure in the docking bay, the mooring module including a plurality of mooring lines that are anchored in the seabed and that are detachably connectable to the upper hull structure to detachably secure the mooring module to the upper hull structure.

2. The spar-type offshore platform of claim 1, further comprising:

a plurality of winches in the upper hull structure adjacent the deck;

a plurality of upper line holding elements on the upper hull structure adjacent the winches; and a plurality of lower line holding elements on the mooring module;

whereby each of the mooring lines extends between one of the upper line holding elements and one of the lower line holding elements.

3. The spar-type offshore platform of claim 1, further comprising a guiding structure on the mooring module that is nestable in the docking bay.

4. The spar-type offshore platform of claim 3, further comprising:

a haul-in winch on the upper hull structure; and a haul-in line wound on the haul-in winch and removably attachable to the guiding structure for raising and lowering the mooring module into and out of the docking bay.

5. The spar-type offshore platform of claim 1, further comprising:

a plurality of guide posts extending upwardly from the mooring module; and a plurality of guide post receptacles located on the upper hull structure so as to receive the guide post, when the mooring module is connected to the upper hull structure.

6. The spar-type offshore platform of claim 5, wherein each of the receptacles includes an axial passage therethrough, and wherein the platform further comprises a guide post line removably attachable to each of the guide posts each of the guide post lines extending from the deck through the passage of one of the receptacles.

7. In a spar-type offshore platform having a buoyant upper hull structure having an upper end supporting a deck and a lower end configured to receive a buoyant lower mooring module to which a plurality of mooring lines are secured, apparatus for detachably connecting the upper hull structure to the lower mooring module, comprising:

a plurality of guide posts extending upwardly from the mooring module;

a plurality of receptacles located on the upper hull structure so that each of the receptacles receives one of the guide posts; and a plurality of connection lines releasably secured between the upper hull structure and the mooring module, wherein the connection lines include the mooring lines, each of which extends from a seabed anchor to the mooring module, and from the mooring module to the deck of the upper hull structure, to which they are releasably secured.

8. The spar-type offshore platform of claim 7, further comprising:

a plurality of winches in the upper hull structure adjacent the deck;

a plurality of upper line holding elements on the upper hull structure adjacent the winches; and a plurality of lower line holding elements on the mooring module;

whereby each of the mooring lines extends between on of the upper line holding elements and one of the lower line holding elements.

9. The spar-type offshore platform of claim 7, further comprising a guiding structure on the mooring module that is nestable in the lower end of the upper hull structure.

10. The spar-type offshore platform of claim 9, further comprising:

a haul-in winch on the upper hull structure; and a haul-in line round on the haul-in winch and removably attachable to the guiding structure for raising and lowering the mooring module into and out of the lower end of the upper hull structure.

11. The spar-type offshore platform of claim 7, wherein each of the receptacles includes an axial passage therethrough, and wherein the platform further comprises a guide post line removably attachable to each of the guide posts each of the guide post lines extending from the deck through the passage of one of the receptacles.

12. A method of (i) removing a deck-supporting buoyant upper hull structure of spar-type offshore platform from a detachable buoyant lower mooring module that is moored to the seabed and that is connected to a lower end o the upper hull structure by mooring lines, and (ii) re-connecting the lower end of the upper hull structure to the mooring module, comprising the steps of:

(a) disconnecting the mooring lines from the upper hull structure while leaving the mooring lines connected to the mooring module;

(b) lowering the mooring module relative to the upper hull structure, while the mooring module remains moored to the seabed;

(c) moving the upper hull structure away from the mooring module while the mooring module remains moored to the seabed;

(d) re-positioning the upper hull structure over the mooring module;

(e) hauling the mooring module up toward the upper hull structure until the mooring module is engaged with the lower end of the upper hull structure; and (f) re-connecting the mooring lines to the upper hull structure.

13. The method of claim 12, wherein the upper hull structure includes a plurality of guide post receptacles, each of which is configured and located to receive a corresponding guide post extending upwardly from the mooring module, and wherein the step of hauling the mooring module includes the step of orienting he mooring module so that each of the guide posts is received in the appropriate guide post receptacle.

14. A spar-type offshore platform, comprising:

an upper hull structure buoyantly supporting a deck, the upper hull structure having a lower end defining a sub-surface docking bay;

a buoyant sub-sea mooring module detachably connected to the upper hull structure in the docking bay, wherein the mooring module is connected to the upper hull structure by a plurality of connection lines that are releasably secured between the mooring module and the upper hull structure;

a plurality of winches on the deck; and a plurality of line guides on the mooring module;

wherein each of the connection lines runs from one of the winches through one of the line guides and back to an anchor point on the upper hull structure, wherein the upper hull structure is detached from the mooring module by slackening the lines so as to decouple them from the line guides.

15. The spar-type offshore platform of claim 14, further comprising a guiding structure on the mooring module that is nestable in the docking bay.

16. The spar-type offshore platform of claim 15, further comprising:

a haul-in winch on the upper hull structure; and a haul-in line wound on the haul-in winch and removably attachable to the guiding structure for raising and lowering the mooring module into and out of the docking bay.

17. The spar-type offshore platform of claim 14, further comprising:

a plurality of guide posts extending upwardly from the mooring module; and a plurality of guide post receptacles located on the upper hull structure so as to receive the guide posts when the mooring module is connected to the upper hull structure.

18. The spar-type offshore platform of claim 17, wherein each of the receptacles includes an axial passage therethrough, and wherein the platform further comprises a guide post line removably attachable to each of the guide posts, each of the guide post lines extending from the deck through the passage of one of the receptacles.

19. In a spar-type offshore platform having a buoyant upper hull structure having an upper end supporting a deck and a lower end configured to receive a buoyant lower mooring module to which a plurality of mooring lines are secured, apparatus for detachably connecting the upper hull structure to the lower mooring module comprising:

a plurality of guide posts extending upwardly from the mooring module;

a plurality of receptacles located on the upper hull structure so that each of the receptacles receives one of the guide posts; and a plurality of connection lines releasably secured between the upper hull structure and the mooring module, wherein the connection lines include tie lines that extend between the mooring module and the deck of the upper hull structure, to which they are releasably secured.

20. The spar-type offshore platform of claim 19, further comprising:

a plurality of winches on the deck; and a plurality of un guides on the mooring module;

wherein each of the tie lines runs from one of the winches through one of the line guides and back to an anchor point on the upper hull structure wherein the upper hull structure is detached from the mooring module by slackening the tie lines so as to decouple them from the line guides.

21. The spar-type offshore platform of claim 19, further comprising a guiding structure on the mooring module that is nestable in the lower end of the upper hull structure.

22. The spar-type offshore platform of claim 21, further comprising:

a haul-in winch on the upper hull structure; and a haul-in line wound on the haul-in winch and removably attachable to the guiding structure for raising and lowering the mooring module into and out of the lower end of the upper hull structure.

23. The spar-type offshore platform of claim 19, wherein each of the receptacles includes an axial passage therethrough, and wherein the platform further comprises a guide post line removably attachable to each of the guide posts, each of the guide post lines extending from the deck through the passage of one of the receptacles.

24. A spar-type offshore platform, comprising:

an upper hull structure buoyantly supporting a deck, the upper hull structure having a lower end defining a sub-surface docking bay;

a buoyant sub-sea mooring module detachably connected to the upper hull structure in the docking bay;

a plurality of guide posts extending upwardly from the mooring module; and a plurality of guide post receptacles located on the upper hull structure so as to receive the guide posts when the mooring module is connected to the upper hull structure, wherein each of the receptacles includes an axial passage therethrough and wherein the platform further comprises a guide post line removably attachable to each of the guide posts, each of the guide post lines extending from the deck through the passage of one of the receptacles.

25. The spar-type offshore platform of claim 24, wherein the mooring module is connected to the upper hull structure by a plurality of connection lines that are releasably secured between the mooring module and the upper hull structure.

26. The spar-type offshore platform of claim 25, further comprising:

a plurality of winches on the deck; and a plurality of line guides on the mooring module;

wherein each of the connection lines runs from one of the winches through one of the line guides and back to an anchor point on the upper hull structure, wherein the upper hull structure is detached from the mooring module by slackening the lines so as to decouple them from the line guides.

27. The spar-type offshore platform of claim 24, wherein the mooring module includes mooring line, that are anchored in the seabed and that are detachably connectable to the upper hull structure to detachably secure the mooring module to the upper hull structure.

28. The spar-type offshore platform of claim 27, further comprising:

a plurality of winches in the upper hull structure adjacent the deck; a plurality of upper line holding elements on the upper hull structure adjacent the winches; and a plurality of lower line holding elements on the mooring module; whereby each of the mooring lines extends between one of the upper line holding elements and one of the lower line holding elements.

29. The spar-type offshore platform of claim 24, further comprising a guiding structure on the mooring module that is nestable in the docking bay.

30. The spar-type offshore platform of claim 29, further comprising:

a haul-in winch on the upper hull structure; and a haul-in line wound on the haul-in winch and removably attachable to the guiding structure for raising and lowering the mooring module into and out of the docking bay.

31. In a spar-type offshore platform having a buoyant upper hull structure having an upper end supporting a deck and a lower end configured to receive a buoyant lower mooring module to which a plurality of mooring lines are secured, apparatus for detachably connecting the upper hull structure to the lower mooring module, comprising:

a plurality of guide posts extending upwardly from the mooring module;

a plurality of receptacles located on the upper hull structure so that each of the receptacles receives one of the guide posts, each of the receptacles having an axial passage therethrough;

a plurality of connection lines releasably secured between the upper hull structure and the mooring module; and a guide post line removably attachable to each of the guide posts, each of the guide post lines extending from the deck through the passage of one of the receptacles.

32. The apparatus of claim 31, wherein he connection lines include the mooring lines, each of which extends from a seabed anchor to the mooring module, and from the mooring module to the deck of the upper hull structure to which they are releasably secured.

33. The spar-type offshore platform of claim 32, further comprising:

a plurality of winches in the upper hull structure adjacent the deck;

a plurality of upper line holding elements on the upper hull structure adjacent the winches; and a plurality of lower line holding elements on the mooring module;

whereby each of the mooring lines extends between one of the upper line holding elements and one of the lower line holding elements.

34. The apparatus of claim 31, wherein the connection lines include tie lines that extend between the mooring in module and the deck of the upper hull structure to which they are releasably secured.

35. The spar-type offshore platform of claim 34, further comprising:

a plurality of winches on the deck; and a plurality of line guides on the mooring module;

wherein each of the tie lines runs from one of the winches through one of the line guides and back to an anchor point on the upper hull structure, wherein the upper hull structure is detached from the mooring module by slackening the tie lines so as to decouple them from the line guides.

36. The spar-type offshore platform of claim 31, further comprising a guiding structure on the mooring module that is nestable in the lower end of the upper hull structure.

37. The spar-type offshore platform of claim 36 further comprising:

a haul-in winch on the upper hull structure; and a haul-in line wound on the haul-in winch and removably attachable to the guiding structure for raising and lowering the mooring module into and out of the lower end of the upper hull structure.

* * * * *